US009199454B1

(12) United States Patent
Linder et al.

(10) Patent No.: US 9,199,454 B1
(45) Date of Patent: Dec. 1, 2015

(54) SYSTEM AND METHOD FOR PRINTHEAD TRANSLATION TO IMPROVE PRINTHEAD RELIABILITY

(71) Applicant: Xerox Corporation, Norwalk, CT (US)

(72) Inventors: Michael J. Linder, Walworth, NY (US); Paul S. Bonino, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/521,169

(22) Filed: Oct. 22, 2014

(51) Int. Cl.
*B41J 2/15* (2006.01)
*B41J 2/045* (2006.01)
*B41J 13/00* (2006.01)

(52) U.S. Cl.
CPC ..... *B41J 2/04588* (2013.01); *B41J 2/04586* (2013.01); *B41J 13/0009* (2013.01)

(58) Field of Classification Search
CPC .... B41J 2/045; B41J 2/04588; B41J 2/04586; B41J 13/0009
USPC ..... 347/40
See application file for complete search history.

(56) References Cited

U.S. PATENT DOCUMENTS

| | | | |
|---|---|---|---|
| 5,589,865 | A | 12/1996 | Beeson |
| 6,457,806 | B2 | 10/2002 | Hickman |
| 6,505,906 | B1 | 1/2003 | Bland et al. |
| 6,739,687 | B1 | 5/2004 | Rasmussen et al. |
| 7,278,699 | B2 | 10/2007 | Drake et al. |
| 2003/0234851 | A1 | 12/2003 | Booth et al. |
| 2004/0085383 | A1 | 5/2004 | Rasmussen |
| 2008/0278527 | A1 | 11/2008 | Newell |
| 2008/0314276 | A1 | 12/2008 | Gothait et al. |

*Primary Examiner* — Alessandro Amari
*Assistant Examiner* — Michael Konczal
(74) *Attorney, Agent, or Firm* — Maginot Moore & Beck LLP

(57) ABSTRACT

A method of operating a printer includes operating an actuator with a controller to move a printhead array during a print job. The controller operates a first subset of inkjets in the printhead array to print to a first print medium during the job and moves a first inkjet in the printhead array over a second print medium while removing a second inkjet that was over the first print medium from being over the second print medium. The controller uses the inkjets that are over the second print medium, including the first inkjet but not the second inkjet, to form a printed image on the second print medium.

16 Claims, 4 Drawing Sheets

SYSTEM AND METHOD FOR PRINTHEAD TRANSLATION TO IMPROVE PRINTHEAD RELIABILITY

TECHNICAL FIELD

The system and method disclosed in this document relates to inkjet printing systems generally, and, more particularly, to systems and methods that prevent inkjets from becoming clogged or inoperable during printing operations.

BACKGROUND

Inkjet printers eject patterns of ink drops to form both single and multicolor printed images. In an inkjet printer, one or more printheads eject drops of ink onto an image receiving surface, such as paper or an indirect image receiving member, and the patterns of individual ink drops give the appearance of text, graphics, and other images. Some inkjet printers eject combinations of multiple ink colors, such as cyan, magenta, yellow, and black (CMYK) inks to form a wide range of perceptible colors in a printed image.

In some embodiments, a printer includes one or more printheads with arrays of inkjets that have a wider span along a cross-process axis than a corresponding width of a print medium that moves through the print zone during printing operation. Some print zones include an array of printheads that are arranged in a lateral "stitched" configuration to form a continuous array of inkjets that covers a region of the print zone that is wider than many types of print media used in the print zone. In other embodiments, a so-called full-width printhead is formed with a sufficiently large array of inkjets to span the width of an entire print zone with the single full-width printhead. For example, in one printer embodiment an array of printheads or a single full-width printhead extend approximately 44.5 cm across the print zone. In many instances, a print job uses a print medium that is narrower than the printhead array. For example, the print zone is noticeably wider than the dimensions of common paper sizes such as A4 sized paper (21 cm×29.7 cm) and Letter sized paper (21.6 cm×27.9 cm). During operation with existing printers, a media transport in the printer aligns the print medium with a portion of the inkjets in the printhead array and a digital controller uses only the inkjets that are aligned with the paper to form printed images while additional inkjets that are positioned beyond the edges of the printer remained deactivated when the dimensions of the print medium are smaller than the print zone.

While existing printers can accommodate a variety of different media sizes in the print zone, prolonged operation of the printer with narrower print media can cause some inkjets in the printhead array that do not eject onto the print media to become inoperable. Using the example print zone described above, an A4 sheet that passes through a 44.5 cm wide print zone with the longer edge (29.7 cm) arranged across the print zone leaves a 14.8 cm portion of the printhead array where inkjets in the printhead array are not aligned with the sheet and cannot eject ink drops onto the sheet. During a print job where the printer processes a large number of A4 sheets, the inkjets that are not aligned with the sheet remain deactivated for a prolonged period of time. During the prolonged period of deactivation, the liquefied ink in the inkjet pressure chambers and other fluid chambers and conduits within the printhead may solidify, develop air bubbles, or otherwise block the operation of the deactivated inkjets. During a subsequent print job that uses a larger media size, some or all of the previously deactivated inkjets may be inoperable and fail to eject ink drops onto portions of the larger print medium.

In existing printers, a printhead maintenance process can clear clogged or otherwise inoperable inkjets. The printhead maintenance process typically requires the printer to suspend regular printing operation and purge ink through the printheads to clear any blockages and prime the inkjets with liquefied ink for continued operation. Some printhead maintenance operations also use wipers or other printhead cleaning devices to clear clogged inkjets. Frequent printhead maintenance operations require consume both time and ink. In many printers that form printed images on different sizes of media during different print jobs, the frequent printhead maintenance operations reduce the effective printing rate of the printer and increase the consumption of ink that is not used for printing operations. Consequently, improved systems and methods for operating a printer to reduce the need to perform printhead maintenance operations while printing on different sizes of print media that are narrower than the width of one or more printhead arrays in the print zone would be beneficial.

SUMMARY

In one embodiment, a method of operating an inkjet printer to reduce or eliminate occurrences of inoperable inkjets due to inkjet inactivity has been developed. The method includes moving with a media transport a first print medium in a process direction past a printhead array in a print zone, the printhead array having a plurality of inkjets arranged along a cross-process axis with the plurality of inkjets having a first width along the cross-process axis that exceeds a second width of the first print medium along the cross-process axis, generating with a controller a first plurality of firing signals to eject ink drops from a first subset of the plurality of inkjets to form a first printed image on the first print medium while a second subset of the plurality of inkjets that are positioned beyond a first edge of the first print medium in the cross-process axis do not eject ink drops, moving with at least one actuator the printhead array in a first direction along the cross-process axis to move a first inkjet in the first subset of the plurality of inkjets beyond a second edge of the first print medium and move a second inkjet in the second subset of the plurality of inkjets within the first edge of the first print medium, moving with the media transport a second print medium in the process direction past the printhead array in the print zone, the second medium having the second width along the cross-process axis, and generating with the controller a second plurality of firing signals to eject ink drops from the second inkjet and the first subset of the plurality of inkjets without the first inkjet to form a second printed image on the second print medium while the first inkjet and the second subset of the plurality of inkjets do not eject ink drops.

In another embodiment, an inkjet printer that is configured to reduce or eliminate occurrences of inoperable inkjets due to inkjet inactivity has been developed. The inkjet printer includes a media transport configured to move print media in a process direction through a print zone, a printhead array arranged in the print zone, the printhead array having a plurality of inkjets arranged along a cross-process axis with the plurality of inkjets having a first width along the cross-process axis that exceeds a second width of a print medium along the cross-process axis, at least one actuator operatively connected to the printhead array, the at least one actuator being configured to move the printhead array in a first direction and a second direction along the cross-process axis, and a controller operatively connected to the media transport, the printhead array, and the at least one actuator. The controller is configured to operate the media transport to move a first print medium in the process direction past the printhead array in the print zone, generate a first plurality of firing signals to eject ink drops from a first subset of the plurality of inkjets to form a first printed image on the first print medium while a second subset of the plurality of inkjets that are positioned beyond a first edge of the first print medium in the cross-process axis do not eject ink drops, operate the at least one actuator to move the printhead array in a first direction along the cross-process axis to move a first inkjet in the first subset of the plurality of inkjets beyond a second edge of the first print medium and move a second inkjet in the second subset of the plurality of inkjets within the first edge of the first print medium, operate the media transport to move a second print medium in the process direction past the printhead array in the print zone, the second print medium having the second width along the cross-process axis, and generate a second plurality of firing signals to eject ink drops from the second inkjet and the first subset of the plurality of inkjets without the first inkjet to form a second printed image on the second print medium while the first inkjet and the second subset of the plurality of inkjets do not eject ink drops.

BRIEF DESCRIPTION OF THE DRAWINGS

An embodiment of this application is described, by way of example, with reference to the accompanying drawings, in which like reference numerals refer to like elements, and in which.

DETAILED DESCRIPTION

Figure 1:
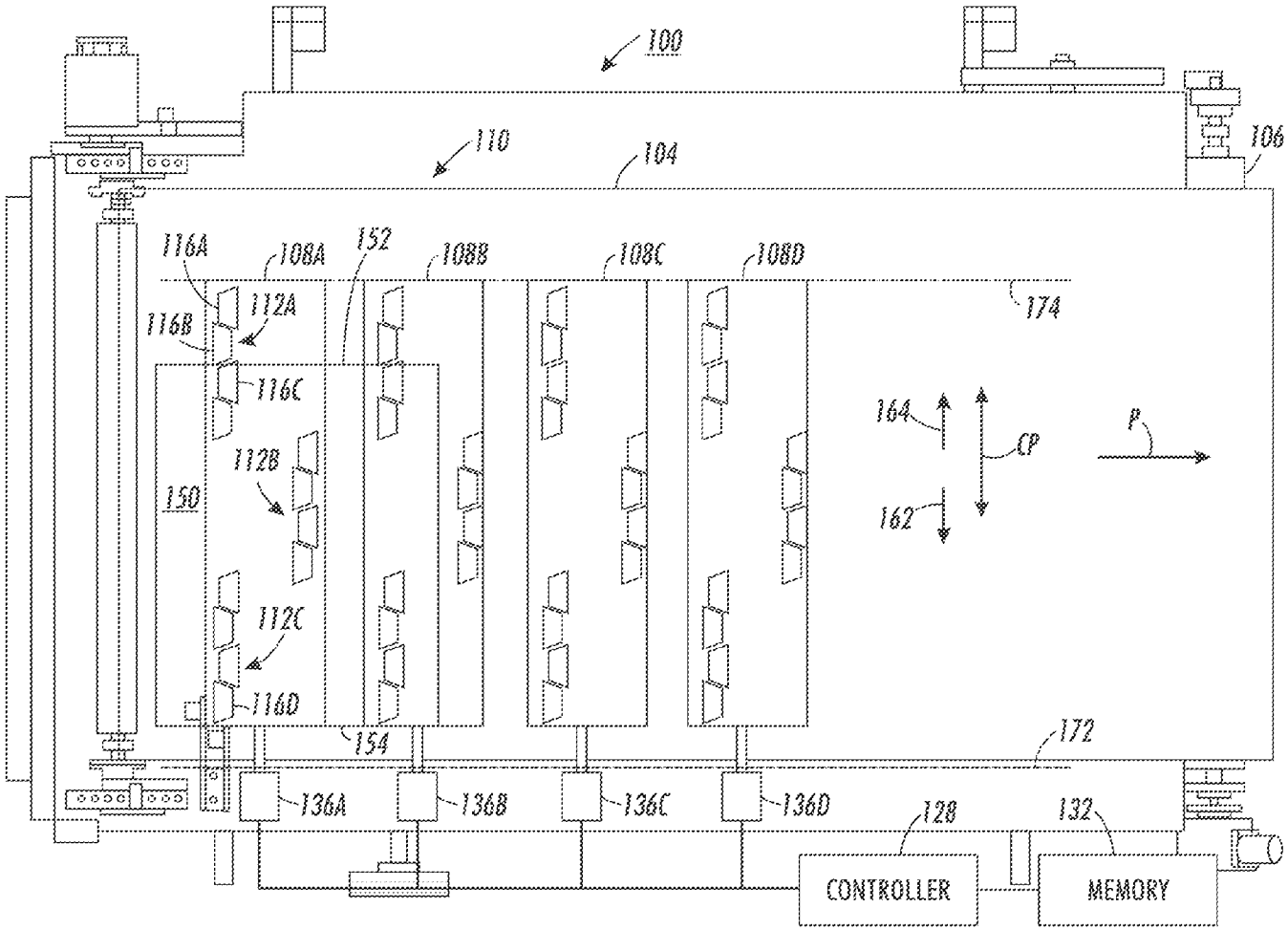
FIG. 1 is a diagram of an inkjet printer including printhead arrays with a width that exceeds a corresponding width of a print medium in the printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, and the like. As used herein, the term "process direction" refers to a direction of movement of a print medium, such as a sheet of paper or a continuous media web pulled from a roll of paper, along a media path through a printer. A media transport in the printer uses one or more actuators, such as electric motors, to move the print medium past one or more printheads in the print zone to receive ink images and passes other printer components, such as heaters, fusers, pressure rollers, and on-sheet optical imaging sensors, that are arranged along the media path. In some embodiments, the media transport uses endless belts, platens, and other members to control the movement of the print medium through the printer. As used herein, the term "cross-process" axis refers to a linear path of that is perpendicular to the process direction along the surface of the print medium. As described below, a printhead array can move in one of two directions along the cross-process axis to reposition inkjet in the printhead array so that all of the inkjets in the printhead array eject ink drops at various stages of a print process.

As used herein, the term "printhead" refers to a device in a print zone of an inkjet printer that incorporates a plurality of individual inkjets that are each configured to eject drops of an ink onto a print medium. The printhead typically includes a reservoir to hold ink and fluid channels that enable the ink in the reservoir to flow to smaller pressure chambers in each of the individual inkjets. The reservoir in the printhead is replenished from an ink supply in the printer. Each of the inkjets includes an actuator, such as a piezoelectric transducer or a thermal element, which receives an electrical firing signal from a controller and ejects a drop of ink through a nozzle in response to the firing signal. The plurality of inkjets in a single printhead and the corresponding inkjet nozzles are formed in a two-dimensional arrangement to eject ink drops onto different portions of a print medium along the cross-process axis. As the print medium moves past the printhead in the process direction, a controller operates the inkjets at selected times to enable the printhead to form a two-dimensional printed image on the print medium. Some printer embodiments use aqueous or solvent based inks that remain in a liquid state until a liquid in the ink (e.g. water or another liquid solvent) evaporates, leaving a dried colorant. Other printer embodiments use phase-change inks that are solid or gelatinous at room temperature and liquefy when heated to a predetermined operating temperature in the printer. In phase-change ink embodiments, the printhead heats and liquefies the phase-change ink, ejects drops of the liquefied ink, and the liquefied ink drops cool and solidify on the surface of the print medium.

As used herein, the term "printhead array" refers to one or more inkjet printheads that include a plurality of the inkjet ejectors. In some embodiments, individual printheads cover a portion of the print zone and the printhead array incorporates multiple printheads that span the entire print zone along the cross-process axis. In other embodiments the printhead array includes a single "full-width" printhead that covers the entire width of the print zone along the cross-process axis.

FIG. 1 depicts an embodiment of an inkjet printer 100. The printer 100 includes a media transport with an endless belt 104 and belt drive roller 106, a print zone 110 including printhead arrays 108A, 108B, 108C, and 108D, and actuators 136A, 136B, 136C, and 136D, and a controller 128 with associated memory 132. In the illustration of FIG. 1, the belt 104 in the media transport moves a first print medium 150 in a process direction P past the printhead arrays 108A-108D during a printing operation. During a print job, the driver roller 106 in the media transport rotates at a predetermined rate to move the drive belt 104 in the process direction P to carry a series of print media past the printhead arrays 108A-108D in the print zone 110. In the operating mode of FIG. 1, each print medium that is printed during the print job has substantially the same width along the cross-process axis as the print medium 150. As depicted in FIG. 1, the printhead arrays 108A-108D each have a first width along the cross-process axis CP that exceeds a second width of the first print medium 150 along the cross-process axis CP.

The print zone 110 is an illustrative embodiment of a multi-color print zone that includes the printhead arrays 108A-108D that are configured to eject drops of cyan, magenta, yellow, and black (CMYK) inks, respectively. As is known in the art, combined patterns of the CMYK ink drops printed on the print medium 150 form a wide range of perceptible colors. In the embodiment of FIG. 1, each printhead array further comprises a plurality of individual printheads that are arranged along the cross-process axis CP to form a continuous line with the individual inkjets in the printheads that can eject ink drops across the print medium 150 in a uniform manner. For example, the printhead array 108A includes three groups of printheads 112A, 112B, and 112C that each further includes four individual printheads arranged along the cross-process axis CP. All of the printheads in the printhead array 108A are held in place by print bars or other support members to hold the printheads in a fixed position relative to one another and to enable the entire printhead array 108A to translate along the cross-process axis CP. In FIG. 1, the actuator 136A is an electromechanical actuator such as a stepper motor or other suitable electromechanical device that moves the printhead array 108A in a first direction 162 and a second direction 164 along the cross-process axis CP. While FIG. 1 depicts a single actuator for each printhead array, alternative embodiments use two or more actuators for each printhead array. The printhead arrays 108B-108D are each configured in the same manner as the printhead array 108A, and the actuators 136B-136D are operatively connected to each of the printhead arrays 108B-108D, respectively, in the same manner as the actuator 136A and printhead array 108A. Alternative printhead array embodiments include a greater number of printheads, fewer printheads, or include a single full-width printhead instead of a plurality of smaller printheads.

In the printer 100, the actuators 136A-136D typically move the printhead arrays 108A-108D, respectively, simultaneously and at substantially similar speeds to maintain registration between the inkjets in the different printheads in the printhead arrays 108A-108D. In an alternative embodiment, each of the printhead arrays 108A-108D is affixed to a single frame or other single member, and a single actuator moves the single member and all of the printhead arrays 108A-108D simultaneously. While FIG. 1 depicts four printhead arrays in a CMYK color printer configuration, alternative print zone configurations include a single printhead array, a greater or lesser number of printhead arrays, printhead arrays that eject different colors of ink, and staggered printhead arrays that include two or more arrays of printheads for each of the CMYK ink colors.

In the configuration of FIG. 1, only a first subset of all the inkjets in each printhead array are positioned in the print zone 110 to be able to eject ink drops onto the print medium 150 as the print medium 150 moves in the process direction P past the printhead arrays 108A-108D. For example, in FIG. 1 all of the inkjets in the printhead 116D are positioned to eject drops on the print medium and most of the inkjets in the printhead 116C are also positioned to eject ink drops onto the print medium 150. However, none of the inkjets in the printheads 116A and 116B are in a position where the ink drops could land on the print medium 150. As depicted in FIG. 1, only the first subset of the inkjets in the printhead array 108A are positioned along the cross-process axis CP between a first edge 152 and a second edge 154 of the print medium 150. A second subset of the inkjets, such as the inkjets in printhead 116A and at least some of the inkjets in printheads 116B and 116C are not in a position to eject ink drops onto the print medium 150. During a printing operation, the controller 128 does not activate the second subset of inkjets that cannot eject ink drops onto the print medium 150 to avoid contamination of the belt 104 and other components in the printer 100.

In the printer 100 the controller 128 is operatively connected to the media transport, each of the printheads in the printhead arrays 108A-108D, and the actuators 136A-136D. The controller 128 is implemented with general or specialized programmable processors that execute programmed instructions. The instructions and data required to perform the programmed functions are stored in a memory 132 that is operatively connected to the controller 128. The memory 132 includes volatile data storage devices such as random access memory (RAM) and non-volatile data storage devices including magnetic and optical disks or solid state storage devices. The processors, their memories, and interface circuitry configure the controllers and/or print engine to perform the functions, such as the difference minimization function, described above. These components are provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits.

During operation, the controller 128 executes stored program instructions from the memory 132 to operate components in the printer 100. In particular, the controller 128 operates the media transport to move a series of print media, such as the first print medium 150, past the printhead arrays 108A-108D in the print zone 110. The controller 128 receives image data for images, including both text and graphics, which the printer forms on the first print medium 150 with printed patterns of ink drops ejected from the inkjets in the printhead arrays 108A-108D. The controller 128 generates electrical firing signals to operate the inkjets in the printhead arrays to form the printed images as the belt 104 carries the print medium 150 past the printhead arrays 108A-108D in the process direction P. As described above, in the configuration of FIG. 1, only a subset of the inkjets in each printhead array are in a position to eject ink drops onto the print medium 150. The controller 128 activates and deactivates inkjets in the printhead arrays 108A-108D based on the cross-process axis positions of the inkjets in each printhead array and the cross-process axis positions of the first edge 152 and second edge 154 of the print medium 150.

As described in more detail below in FIG. 3, the controller 128 operates the actuators 136A-136D to move the printhead arrays 108A-108D, respectively, in the first direction 162 and the second direction 164 along the cross-process axis CP. The controller 128 moves the printhead arrays 108A-108D during printing operations to ensure that every inkjet in the print zone 110 is positioned over a print medium during print jobs. The controller 128 operates each of the inkjets to eject ink drops that land on a print medium as different subsets of the inkjets move into position over the print medium. Thus, the controller 128 operates all of the inkjets in the printhead arrays 108A-108D during a prolonged print job. Since all of the inkjets in the print zone eject ink drops within a predetermined maximum time (e.g. 20 minutes) between successive ink drop ejection operations, the inkjets do not dry out or otherwise clog due to inactivity. In the printer 100, the print job continues as the actuators 136A-136D translate the printhead arrays 108A-108D without requiring a specialized printhead maintenance process.

The controller 128 operates the actuators 136A-136D to produce a rather slow rate of translation movement for the printhead arrays 108A-108D. In the embodiment of FIG. 1, the actuators 136A-136D move the printhead arrays 108A-108D at an average rate of approximately 38.1 millimeters per minute to translate the printhead arrays 108A-108D by a distance of 7.6 cm over a 20 minute period. In some embodiments, the controller 128 operates the actuators 136A-136B continuously, and the low rate of translation means that the printhead arrays only move along the process direction by a small distance (e.g. less than 100 μm) while printing onto any single print medium during a print job. In other embodiments, the controller 128 operates the actuators 136A-136B only between printing operations after one print medium passes a printhead array and prior to the arrival of the next print medium at the printhead array. As depicted in FIG. 1, the actuators 136A-136D are configured to move the printhead arrays 108A-108D, respectively, between two different maximum positions in the first direction 162 and the second direction 164 along the cross-process axis CP. When the printhead arrays reach the maximum position 172 in the first direction 162, the controller 128 reverses the direction of translations movement for the actuators to move the printhead arrays in the second direction 164. Similarly, when the printhead arrays reach the maximum position 174 in the second direction 164, the controller 128 reverses the direction of translation movement for the actuators back to the first direction 162.

The printer 100 continues the gradual movement of the printhead arrays 108A-108D between the maximum positions 172 and 174 during a print job to enable all of the inkjets in the printhead arrays 108A-108D to be positioned over print media during a print job. In the illustrative configuration of FIG. 1, the printhead arrays 108A-108D are located at or near the maximum position 174 and the actuators 136A-136D are configured to move the respective printhead arrays 108A-108D in the first direction 162 to move inkjets in the printheads 116A and 116B over subsequent print media that move through the print zone 110.

Figure 2A:
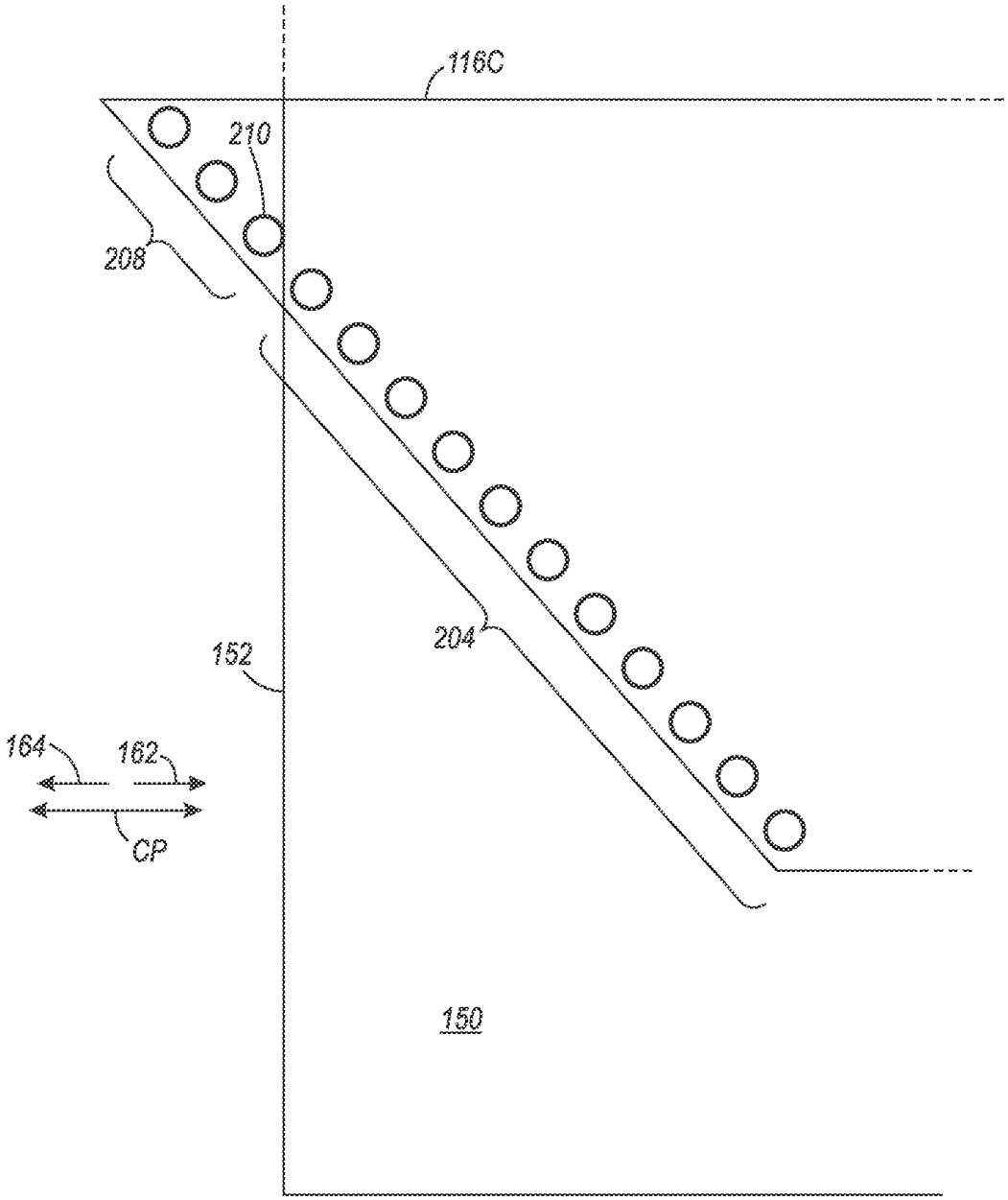
FIG. 2A is a diagram depicting inkjets in one printhead of the printer of FIG. 1 near a first edge of a print medium.

As described above, in the configuration of FIG. 1, the width of each of the printhead arrays 108A-108D along the cross-process axis CP is wider than the width of the print medium 150. FIG. 2A depicts the printhead 116C of FIG. 1 over the print medium 150 in more detail. FIG. 2A the nozzles of inkjet groups 204 and 208, which form a portion of the inkjets in the printhead 116C. The inkjets 204 are positioned over the surface of the print medium 150 within the first edge 152. The inkjets 208 are positioned beyond the first edge 152 of the print medium 150. In the configuration of FIG. 2A, the inkjets 204 are part of the first subset of inkjets that are positioned to eject ink drops onto the print medium 150 and the inkjets 208 are part of the second subset of inkjets that are not in a position to eject ink drops onto the print medium 150. During the printing operation, the controller 128 operates the actuator 136, and the printhead array 108A, including printhead 116C, moves in the first direction 162. As a second print medium moves past the printhead 116C, at least one inkjet from the second subset of inkjets, such as the inkjet 210, moves over the first edge of the second print medium and can eject ink drops onto the surface of the print medium. Over time, the inkjets in the printheads 116A and 116B also move over the print medium as the actuator 136A continues to translate the printhead array 108 in the first direction 162. The controller 128 selectively activates and deactivates inkjets to only use the inkjet that are in position to eject ink drops onto the print medium.

Figure 2B:
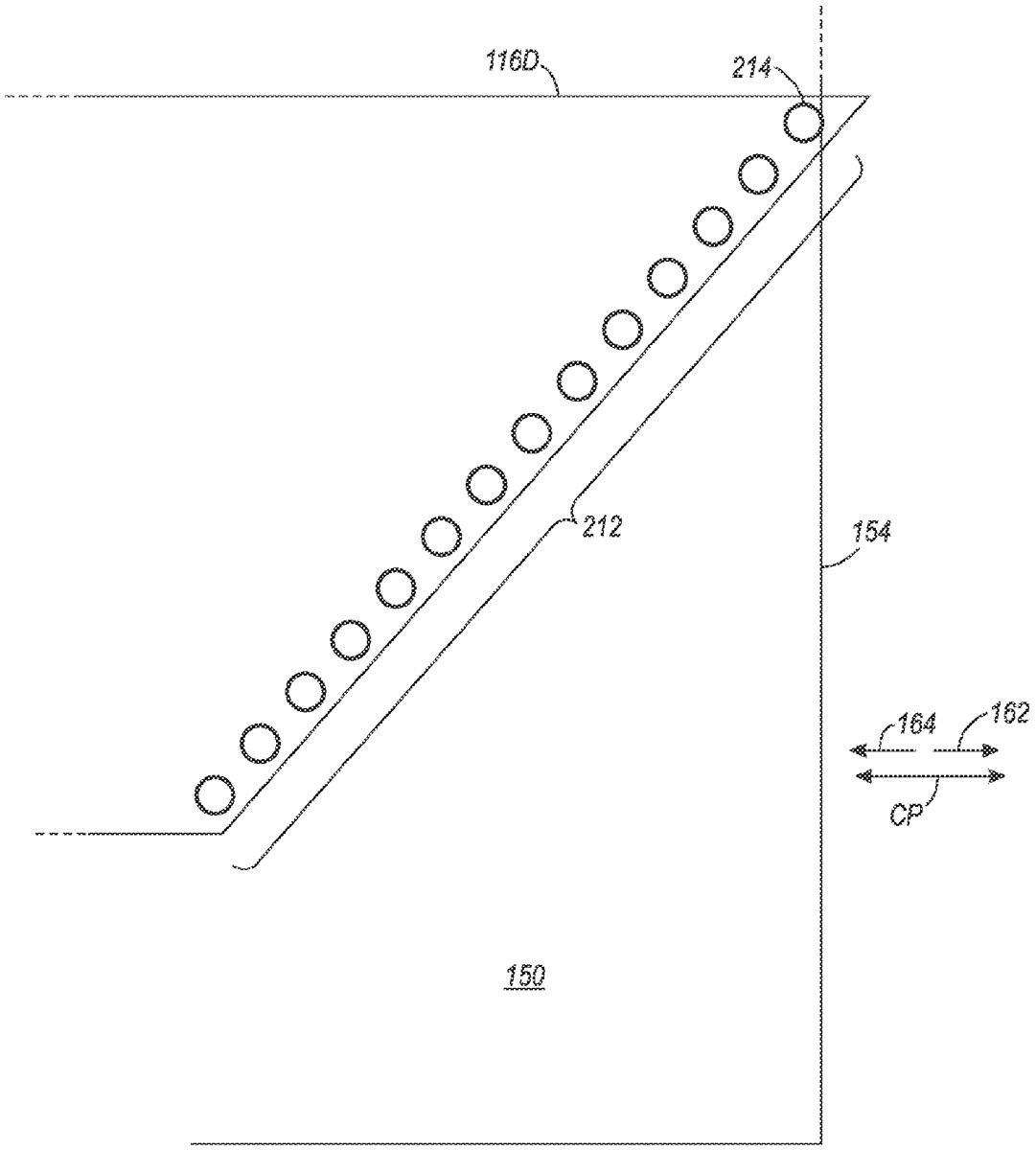
FIG. 2B is a diagram depicting inkjets in another printhead of the printer of FIG. 1 near a second edge of the print medium.

FIG. 2B depicts the printhead 116D in the printhead array 108A. In the configuration of FIG. 2B, all of the inkjets 212 in the printhead 116D are positioned over the print medium 150, and can eject ink drops onto the surface of the print medium 150. However, as the controller 128 operates the actuator 136A, the printhead array 108A and the printhead 116D move in the first direction 162, which moves at least one inkjet, such as inkjet 214, beyond the second edge 154 of the print medium 150. During a subsequent printing operation of a second print medium, the controller 128 does not operate the inkjet 214 and any other inkjets that have moved past the second edge of the second print medium. More generally, as depicted in FIG. 2A and FIG. 2B, movement of the printhead array 108A typically moves a first number of inkjets within one edge of the print medium to enable those inkjets to eject ink drops onto the print medium while the same movement also removes an equal or similar second number of inkjets beyond another edge of the print medium where the second number of inkjets cannot eject ink drops onto the print medium.

Figure 3:
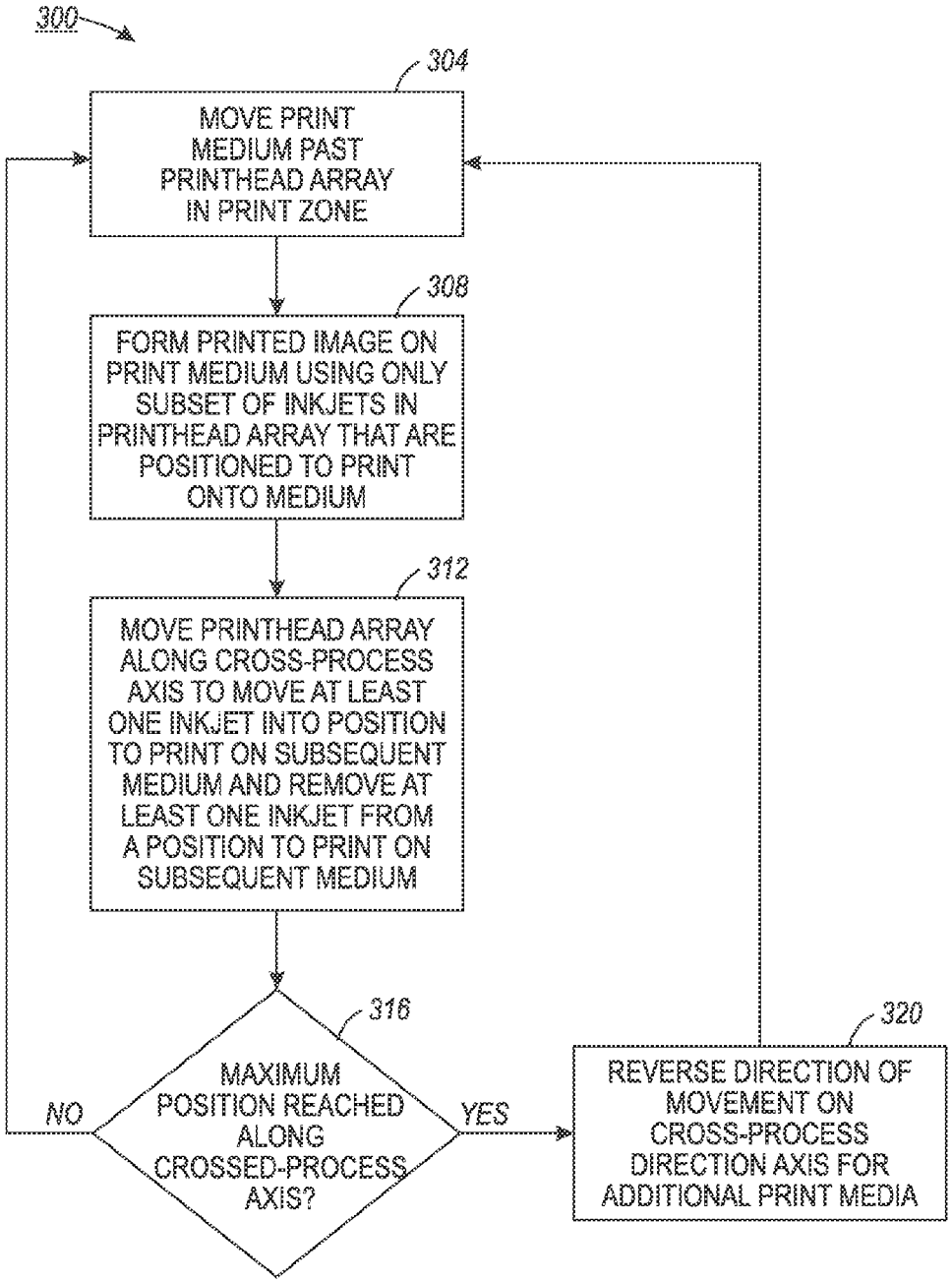
FIG. 3 is a block diagram of a process for moving printhead arrays along a cross-process axis to reposition different sets of inkjets over a print medium during a print job to prevent inkjets from becoming inoperable due to prolonged inactivity.

FIG. 3 depicts a process 300 for operation of a print zone to reduce or eliminate the occurrence of inoperable inkjets in printhead arrays due to prolonged inactivity. In the discussion below, a reference to the process 300 performing an action or function refers to the execution of stored program instructions by a controller to perform the function or action using other components in the printer. The process 300 is described in conjunction with the printer 100 of FIG. 1 for illustrative purposes.

During process 300, the substrate transport moves a series of print media, such as the print medium 150 in the process direction, past the printhead array in the print zone (block 304). In the printer 100, the driver roller 106 pulls the endless belt 104 in the process direction P to carry each print medium past the printhead arrays 108A-108D in the print zone 110. The print media move through the print zone in a series as the printer 100 forms printed images on each print medium. FIG. 3 depicts an iteration of the process 300 to describe the processing that occurs during the printing of each print medium during a print job in the printer 100.

The process 300 continues as the controller 128 generates a plurality of firing signals to operate the first subset of inkjets in the printheads 108A-108D that are positioned in the print zone 110 to eject ink drops onto the surface of the print medium 150 (block 308). The controller 128 identifies the positions of the printhead arrays 108A-108D and only operates the subset of inkjets that are within the first edge 152 and second edge 154 of the print medium 154. The controller 128 performs print image processing to reproduce a digital page image as a printed image on the print medium 150 using techniques that are known to the art. Of course, in many print jobs not every inkjet in the first set of inkjets would be activated while over the print medium 150 or other print media during the print job. In some embodiments, the controller 128 selectively operates inkjets in the first subset of inkjets that are not otherwise used to form the printed image. For example, in some embodiments the controller 128 generates random electrical firing signals to operate otherwise unused inkjets that eject ink drops onto a margin of the print medium 150 or onto another printed region of the print medium 150. The controller 128 operates the otherwise unused inkjets at very low densities, such as single-drops, to prevent the randomly ejected ink drops from being easily perceptible in the final printed document. In other embodiments, the printhead arrays form predetermined printed test patterns in the margins of some print media during a print job, and the controller 128 operates all of the inkjets in the print zone 110 at various times to form the printed test patterns.

In the printer 100 the controller 128 operates the actuators 136A-136D to move the printhead arrays 108A-108D, respectively, in the first direction 162 or the second direction 164 along the cross-process axis CP. During the process 300, the movement of the printhead arrays moves at least one inkjet that is beyond the edge of a first print medium during the print job within the edges of a subsequent print medium during the print job while at least one other inkjet that is positioned within the edges of the first print medium during the print job moves beyond the edge of the subsequent print medium (block 312). As described above, in one embodiment the controller 128 operates the actuators 136A-136D to move the printhead arrays 108A-108D, respectively, in a continuous manner in either the first direction 162 or second direction 164. In the continuous movement embodiment, the controller 128 operates the actuators 136A-136D in a continuous manner for continuous printhead array movement throughout the process 300 including during and between printing operations on each print medium in the print job. As described above, the rate of movement for the printhead arrays 108A-108D during continuous movement is typically slow so that the total distance that each printhead array travels along the cross-process axis while printing to a single print medium is small, typically less than 100 μm and in one embodiment approximately 25 μm. In another embodiment, the controller 128 generates the plurality of firing signals to eject ink drops onto a first print medium, activates the actuators 136A-136D to move the printhead arrays 108A-108D, respectively, only after finishing the printing of the first print medium, and then deactivates the actuators to halt movement of the printhead arrays prior to generating a second plurality of firing signals to begin ejecting ink drops onto a second print medium during the process 300.

During process 300, the controller operates the actuators 136A-136D to move the printhead arrays 108A-108D, respectively, in either the first direction 162 or the second direction 164 until reaching the maximum position for the printhead arrays 108A-108D (block 316). If the printhead arrays 108A-108D have not reached the maximum position, then the process 300 returns to block 304 and the printhead arrays continue to move in either the first direction 162 toward the maximum position 172 or the second direction 164 toward the second maximum position 174. The operation of the actuators 136A-136D eventually moves the respective printhead arrays 108A-108D to the maximum position in either the first direction or the second direction along the cross-process axis (block 316). In the printer 100, one or more position sensors in the print zone 110 or that are incorporated in the actuators 136A-136D enable the controller to identify the position of the printhead arrays 108A-108D along the cross-process axis and identify if the printhead arrays have reached either of the maximum positions 172 and 174. The controller 128 reverses the direction of motion for the actuators 136A-136D (block 320), and the process 300 returns to block 304 to process the next print medium during the print job. For example, the controller 128 operates the actuators 136A-136D to move the printhead arrays 108A-108D, respectively, in the second direction 164 when the printhead arrays 108A-108D reach the first maximum position 172, and the controller 128 operates the actuators 136A-136D to move the printhead arrays 108A-108D, respectively, in the first direction 162 when the printhead arrays 108A-108D reach the second maximum position 174.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed:

1. A method of operating an inkjet printer comprising:

operating with a controller a media transport to move a first print medium in a process direction past a printhead array in a print zone, the printhead array having a plurality of inkjets arranged along a cross-process axis with the plurality of inkjets having a first width along the cross-process axis that exceeds a second width of the first print medium along the cross-process axis;

generating with the controller a first plurality of firing signals that the controller sends to a first subset of the plurality of inkjets to eject ink drops from the first subset of the plurality of inkjets and form a first printed image on the first print medium while a second subset of the plurality of inkjets that are positioned beyond a first edge of the first print medium in the cross-process axis do not eject ink drops;

operating with the controller at least one actuator to move the printhead array in a first direction along the cross-process axis to move a first inkjet in the first subset of the plurality of inkjets beyond a second edge of the first print medium and move a second inkjet in the second subset of the plurality of inkjets within the first edge of the first print medium;

operating with the controller the media transport to move a second print medium in the process direction past the printhead array in the print zone, the second medium having the second width along the cross-process axis; and generating with the controller a second plurality of firing signals that the controller sends to the second inkjet and the first subset of the plurality of inkjets without the first inkjet to eject ink drops from the second inkjet and the first subset of the plurality of inkjets without the first inkjet and form a second printed image on the second print medium while the first inkjet and the second subset of the plurality of inkjets do not eject ink drops.

2. The method of claim 1, the movement of the printhead array further comprising:

operating with the controller the at least one actuator to move the printhead array in only the first direction continuously during the generation of the first plurality of firing signals to form the first printed image on the first print medium and during the generation of the second plurality of firing signals to form the second printed image on the second print medium.

3. The method of claim 2, the movement of the printhead array further comprising:

operating with the controller the at least one actuator to move the printhead array in the first direction on the cross-process axis by a distance that does not exceed 100 μm during the generation of the first plurality of firing signals to form the first printed image on the first print medium; and operating with the controller the at least one actuator to move the printhead array in the first direction on the cross-process axis by a distance that does not exceed 100 μm during the generation of the second plurality of firing signals to form the second printed image on the second print medium.

4. The method of claim 1, the movement of the printhead array further comprising:

operating with the controller the at least one actuator to move the printhead array in the first direction after the generation of the first plurality of firing signals to form the first printed image on the first print medium and prior to the generation of the second plurality of firing signals to form the second printed image on the second print medium.

5. The method of claim 4 further comprising:

operating with the controller the at least one actuator to move the printhead array in the first direction only after the generation of the first plurality of firing signals to form the first printed image on the first print medium; and deactivating with the controller the at least one actuator to halt movement of the printhead array prior to the generation of the second plurality of firing signals to form the second printed image on the second print medium.

6. The method of claim 1 further comprising:

identifying with the controller that the printhead array has reached a maximum position in the first direction along the cross-process axis; and operating with the controller the at least one actuator to move the printhead array in a second direction along the cross-process axis in response to the printhead array reaching the maximum position in the first direction.

7. The method of claim 6 further comprising:

identifying with the controller that the printhead array has reached a maximum position in the second direction along the cross-process axis; and operating with the controller the at least one actuator to move the printhead array in the first direction along the cross-process axis in response to the printhead array reaching the maximum position in the second direction.

8. An inkjet printer comprising:

a media transport configured to move print media in a process direction through a print zone;

a printhead array arranged in the print zone, the printhead array having a plurality of inkjets arranged along a cross-process axis with the plurality of inkjets having a first width along the cross-process axis that exceeds a second width of a print medium along the cross-process axis;

at least one actuator operatively connected to the printhead array, the at least one actuator being configured to move the printhead array in a first direction and a second direction along the cross-process axis; and a controller operatively connected to the media transport, the printhead array, and the at least one actuator, the controller being configured to:

operate the media transport to move a first print medium in the process direction past the printhead array in the print zone;

generate a first plurality of firing signals to eject ink drops from a first subset of the plurality of inkjets to form a first printed image on the first print medium while a second subset of the plurality of inkjets that are positioned beyond a first edge of the first print medium in the cross-process axis do not eject ink drops;

operate the at least one actuator to move the printhead array in a first direction along the cross-process axis to move a first inkjet in the first subset of the plurality of inkjets beyond a second edge of the first print medium and move a second inkjet in the second subset of the plurality of inkjets within the first edge of the first print medium;

operate the media transport to move a second print medium in the process direction past the printhead array in the print zone, the second print medium having the second width along the cross-process axis; and generate a second plurality of firing signals to eject ink drops from the second inkjet and the first subset of the plurality of inkjets without the first inkjet to form a second printed image on the second print medium while the first inkjet and the second subset of the plurality of inkjets do not eject ink drops.

9. The inkjet printer of claim 8, the controller being further configured to:

operate the at least one actuator to move the printhead array in only the first direction continuously during the generation of the first plurality of firing signals to form the first printed image on the first print medium and during the generation of the second plurality of firing signals to form the second printed image on the second print medium.

10. The inkjet printer of claim 9, the controller being further configured to:

operate the at least one actuator to move the printhead array in the first direction on the cross-process axis by a distance that does not exceed 100 μm during the generation of the first plurality of firing signals to form the first printed image on the first print medium; and operate the at least one actuator to move the printhead array in the first direction on the cross-process axis by a distance that does not exceed 100 μm during the generation of the second plurality of firing signals to form the second printed image on the second print medium.

11. The inkjet printer of claim 8, the controller being further configured to:

operate the at least one actuator to move the printhead array in the first direction after the generation of the first plurality of firing signals to form the first printed image on the first print medium and prior to the generation of the second plurality of firing signals to form the second printed image on the second print medium.

12. The inkjet printer of claim 11, the controller being further configured to:

operate the at least one actuator to move the printhead array in the first direction only after the generation of the first plurality of firing signals to form the first printed image on the first print medium; and deactivate the at least one actuator to halt movement of the printhead array in the first direction prior to the generation of the second plurality of firing signals to form the second printed image on the second print medium.

13. The printer of claim 8, the controller being further configured to:

identify that the printhead array has reached a maximum position in the first direction along the cross-process axis; and operate the at least one actuator to move the printhead array in a second direction along the cross-process axis in response to the printhead array reaching the maximum position in the first direction.

14. The printer of claim 13, the controller being further configured to:

identify that the printhead array has reached a maximum position in the second direction along the cross-process axis; and operate the at least one actuator to move the printhead array in the first direction along the cross-process axis in response to the printhead array reaching the maximum position in the second direction.

15. The inkjet printer of claim 8, the printhead array comprising:

a plurality of printheads arranged along the cross-process axis.

16. The inkjet printer of claim 8, the printhead array comprising:

a single printhead arranged along the cross-process axis.

* * * * *